United States Patent [19]

Focke et al.

[11] Patent Number: 4,885,895

[45] Date of Patent: Dec. 12, 1989

[54] PROCESS AND APPARATUS FOR FEEDING BLANKS TO A FOLDING UNIT

[75] Inventors: Heinz Focke, Verden; Jurgen Wach, Bremen, both of Fed. Rep. of Germany

[73] Assignee: Focke & Co. (GmbH & Co.), Verden, Fed. Rep. of Germany

[21] Appl. No.: 204,138

[22] Filed: May 27, 1988

[30] Foreign Application Priority Data

Jun. 30, 1987 [DE] Fed. Rep. of Germany ..... 3721459

[51] Int. Cl.[4] ..... B65B 57/12

[52] U.S. Cl. ..... 53/73; 53/234; 53/389

[58] Field of Search ..... 53/54, 64, 73, 234, 53/389

[56] References Cited

U.S. PATENT DOCUMENTS

| | | | |
|---|---|---|---|
| 2,953,880 | 9/1960 | Sramek et al. | 53/389 |
| 3,136,104 | 6/1964 | Geer et al. | 53/234 |
| 3,527,014 | 9/1970 | Wahle et al. | 53/234 |
| 4,135,344 | 1/1979 | Seragnoli | 53/389 |
| 4,428,177 | 1/1984 | Focke et al. | 53/234 |
| 4,711,065 | 12/1987 | Focke et al. | 53/234 |

*Primary Examiner*—W. Donald Bray

*Attorney, Agent, or Firm*—Sughrue, Mion, Zinn, Macpeak & Seas

[57] ABSTRACT

During the wrapping of articles (stack 10) in blanks (11), the latter are severed from a web of material (21) and fed to a folding turret (13). When the delivery of articles (10) to be wrapped is interrupted, the severing of blanks (11) and the feeding of these to the folding turret (13) are also interrupted. For this pupose, while knife rollers (26, 29) continue to run, the web of material (21) is stopped after it has been conveyed beyond the severing point an amount corresponding to a follow-up portion (44). The knives (severing knives 30) of the knife rollers (26, 29) rotating further are moved out of their cutting position.

15 Claims, 3 Drawing Sheets

PROCESS AND APPARATUS FOR FEEDING BLANKS TO A FOLDING UNIT

BACKGROUND OF THE INVENTION

The invention relates to a process for feeding blanks of packaging material to a folding unit, especially to a folding turret, for the wrapping of articles or groups of articles, the blanks being severed from a continuous web of material by knives of rotating knife rollers and being fed to the folding turret or to a transfer roller preceding the latter. The invention relates, furthermore, to an apparatus for producing blanks and feeding them to a folding unit.

Blanks for the wrapping of articles are often produced, in packaging machines, by severing a roll of material and by feeding them directly to a folding unit, especially a folding turret. This applies, above all, to the processing of blanks from (plastic) film material. The blanks are conventionally severed from the web of material, during the predominantly continuous conveyance of the latter, by rotating knife rollers having severing knives and counter knives and are fed, by means of likewise rotating conveyor members, to a peripheral surface of the folding turret in the region of a pocket for receiving the articles. In a pushing-in station, the articles to be wrapped are each pushed in the radial direction into a pocket of the folding turret, thereby being partially wrapped in the blank. The feed of the articles to be wrapped, on the one hand, and the severing and delivery of the blanks, on the other hand, are coordinated with one another.

When there is a temporary interruption in the feed of articles to the folding turret, the uninterrupted production of blanks and their delivery to the folding turret lead to considerable disruption in the operating cycle.

SUMMARY OF THE INVENTION

The object on which the invention is based is to avoid such disruption by means of a coordinated interruption in the feed of blanks to the folding turret or the like when there is a temporary interruption in the feed of articles to be wrapped.

To achieve this object, the process according to the invention is characterized in that the feed of blanks to the folding turret is controlled as a function of the feed of articles to be packaged, in such a way that, when there is an interruption in the feed of articles, the transfer of blanks to the folding turret is interrupted until articles are fed to the folding turret once again.

In the invention, the delivery of articles to be wrapped to the folding turret is monitored, for example by means of an optoelectrical monitoring device. When the delivery is interrupted, a corresponding signal is transmitted to units for conveying the web of material and for severing and transporting the blanks, so that these units do not sever or deliver to the folding turret any further blanks.

At the same time, according to the invention, the drive of rotating conveyor members for the blanks and for the web of material is maintained, including the rotary movement of the knife rollers, but the web of material for producing the blanks is stopped in a region in front of the knife rollers, so that further blanks are no longer severed. A special feature of this invention is that the web of material is conveyed an amount corresponding to a follow-up portion beyond the effective plane of the knives (severing knife and counter knife) and is then stopped. The follow-up portion of the web of material which goes beyond the severing plane is shorter than the length of a blank and is coordinated with the movement of the articles to be wrapped, with the conveyor members for the web of material and with the blanks, including the knife rollers, in such a way that, at the restart of the transport of the articles and consequently of the web of material, a blank is severed at a moment coordinated with the movement of the articles and of the folding turret. Synchronism between blank and article to be wrapped is thus reestablished immediately and without the loss of a blank or without a missing wrapping.

During the temporary stop in conveyance the knives of the knife rollers are brought into an ineffective position for the web of material, so that a severing cut is not made despite the rotation of the knife rollers.

The apparatus according to the invention for severing blanks from a web of material and feeding these blanks to the peripheral surface of the folding turret comprises rotating conveyor members, including rotating knife rollers, which are preceded by a pair of drawing rollers for transporting the web of material, and which are disconnectable in a controlled manner when there is no feed of articles, the knives of the knife rollers at the same time coming out of the cutting position.

The severing knives projecting with a cutting edge beyond a peripheral surface of the knife rollers are moveable out of the cutting position by means of moveable control members fixed in place, and in particular are pivotable against spring-loading.

Further features of the invention relate to the conveyance of the web of material and of the blanks and to the design of the knife rollers and knives.

An exemplary embodiment of the invention is explained in detail below with reference to the drawings. In these:

DETAILED DESCRIPTION OF A PREFERRED EMBODIMENT

Figure 1:
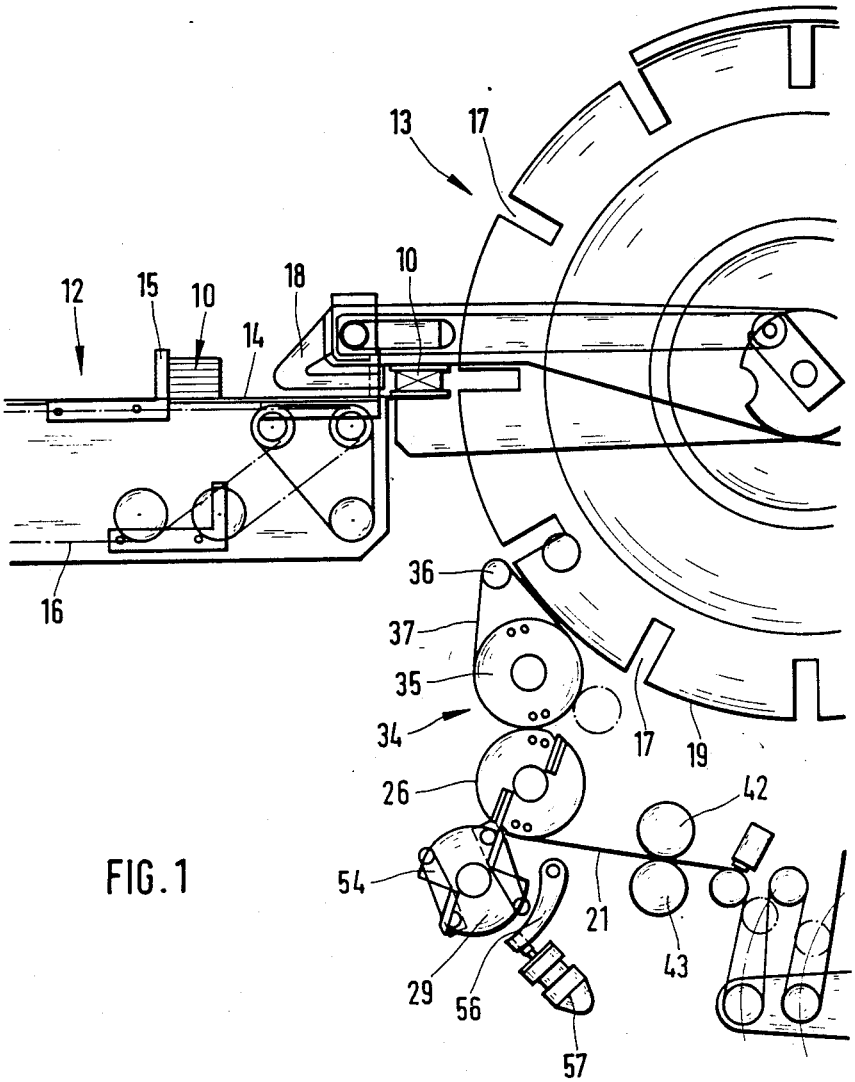
FIG. 1 shows a diagrammatic side view of a part region of a folding turret with units for feeding articles to be wrapped, for the conveyance of a web of material and the production and conveyance of blanks, FIG. 2 likewise shows a side view, on an enlarged scale, of details in the region of transport of the web of material and of the blanks, FIG. 3 likewise shows a side view of knife rollers on a further-enlarged scale.

The exemplary embodiment illustrated in the drawings is concerned with the packaging of stacks 10 of folded paper handkerchiefs into a blank 11 of film material, for example polyethylene film. The articles to be wrapped, that is to say stacks 10 are fed to a folding turret 13 by means of a horizontal delivery conveyor 12. The delivery conveyor 12 consists of a stationary bearing plate 14 for supporting the stacks 10 and of angular drivers 15 which are moved over the bearing plate 14 by means of chain drives 16.

The folding turret 13 is equipped with a multiplicity of pockets 17 which are open on the radially outer face and into each of which a stack 10, compressed to the dimension of the pocket 17, is pushed in the radial direction, specifically at the same time taking with it a blank 11 which wraps around the stack 10 in a U-shaped manner during the pushing-in movement. The delivery conveyor 12 is approximately in the horizontal mid-plane of the vertically arranged folding turret. The stacks 10 are pushed into the pockets 17 by a pushing-in device 18 moveable to and fro. The delivery conveyor 12, folding turret 13 and further members are appropriately designed as illustrated and described in German patent application P3,701,273.8.

The blanks 11 are produced in a blank station preceding the above-described pushing-in station in the direction of rotation of the folding turret 13 and are laid against the outer peripheral surface 19 of the folding turret 13 in the region of a pocket 17. The positioning of the blanks 11 on the peripheral surface 19 is such that each of them covers a pocket 17. When a stack 10 is pushed into a pocket, the blank is thus taken up and partially wraps the stack 10. Suction bores 20 for fixing the blank 11 open out in the region of the peripheral surface 19.

The blanks 11 are severed from the web of material 21. Web is drawn off from a reel (not shown) and fed, via deflecting rollers 22, 23 with a double rocker 24, to a severing unit for producing the blanks 11. The moveable double rocker 24 serves for compensating fluctuations in the delivery of the web of material 21, so that the web always has a uniform conveying speed in the region of severance of the blanks. A photocell 25 for monitoring the accurate run of the web of material 21 is mounted in the region of the deflecting roller 22.

In order to sever the blanks 11, the web of material runs over a (first) knife roller 26 with two knives, in particular counter knives 27 which are arranged and designed conventionally, in such a way that a cutting edge 28 projects slightly beyond the peripheral surface of the knife roller 26.

Arranged immediately opposite the knife roller 26 in a paraxial manner is a second knife roller 29, which likewise has two knives located diametrically opposite one another, in particular severing knives 30. The distance between the knife rollers 26 and 29 is selected so that a cutting edge 31 of the severing knives 30, which likewise projects beyond the periphery of the knife roller 29, interacts with a counter knife 27 in the region of least distance in such a way that the web of material 21 is severed, thereby forming a blank 11. The first knife roller 26 runs in the clockwise direction and the second knife roller 29 in the anti-clockwise direction. Thus, in the region of a severing plane or severing point for the web of material 21, the severing knives 30 and counter knives 27 run in the same direction.

The web of material 21 is brought up to the peripheral or outer surface of the first knife roller 26. The latter is equipped with suction bores 32, which open out on the peripheral surface and which, during the rotation of the knife roller 26, are temporarily connected to a suction segment 33 of a stationary suction disk of known design. The arrangement or dimensions of the suction segment 33 are such that, in the region of the severing cut, the web of material 21 is fixed to the periphery of the knife roller 26 sufficiently for further transport by the latter. The suction segment 33 accordingly extends on both sides of the severing plane and then in the conveying direction of the knife roller up to a region where the blank 11 is transferred to a following conveyor, in the present case into the region of a transfer conveyor 34. The front region of the web of material 21 and, after the severing cut, the blank 11, are therefore retained on the periphery of the knife roller 26 by means of suction air.

In the present exemplary embodiment, the transfer conveyor 34 is designed as a belt conveyor. A larger conveyor roller 35 receives the blanks 11 in succession. Belts 37 are looped both round a smaller deflecting roller 36 located at a distance from this and round the conveyor roller 35. The belts 37 consist of several elastic bands arranged next to one another, especially O-rings, which run in peripheral grooves 38 of the conveyor roller 35 and of the deflecting roller 36. The belts 37 arranged at axial distances from one another are thereby essentially flush with the outer surface of the conveyor roller 35 and of the deflecting roller 36. The blanks 11 can thus rest against the outer surface of the conveyor roller 35 which is provided, in the region between the belts 37, with suction bores 39 which in turn, during part of the rotation, come into communication with a fixed suction segment 40 and are thereby actuated by suction air.

The blanks 11 are conveyed by the knife roller 26 along a portion somewhat less than half the periphery of the latter and are then transferred to the immediately adjacent conveyor roller 35. In this region, the suction bore retaining the particular blank 11 or the web of material 21 on the outer surface of the knife roller 26 is connected to a fixed ventilating bore 41, so that the blank 11 or the web of material 21 is no longer retained in this region, but changes over from the outer surface of the knife roller 26 to the periphery of the conveyor roller 35 as a result of the suction bore 39 which is effective in this region and which is actuated by suction air. In the present case, the dimensions are such that the length of a blank 11 on the transport direction is greater than the region of contact on the knife roller 26, so that the web of material 21 already rests against the conveyor roller 35 before the severing cut.

After the severing cut, the blank 11 is laid by the conveyor roller 35 against the peripheral surface 19 of the folding turret 13 and retained along a certain conveying distance by the belts 37 which likewise lie snugly against this peripheral surface 19.

The severing of the blanks 11 and their conveyance to the folding turret 13 are dependent on the delivery of articles, in particular stacks 10, in such a way that, if there are no stacks 10 in the region of the delivery conveyor 12, no blanks 11 are laid against the folding turret 13.

For this purpose, the feed of the stacks 10 in the region of the delivery conveyor 12 is monitored, for example by means of optical sensors. If a gap in the feed of the stacks 10 occurs, the drive of the web of material 21 is interrupted in a controlled way.

Figure 3:
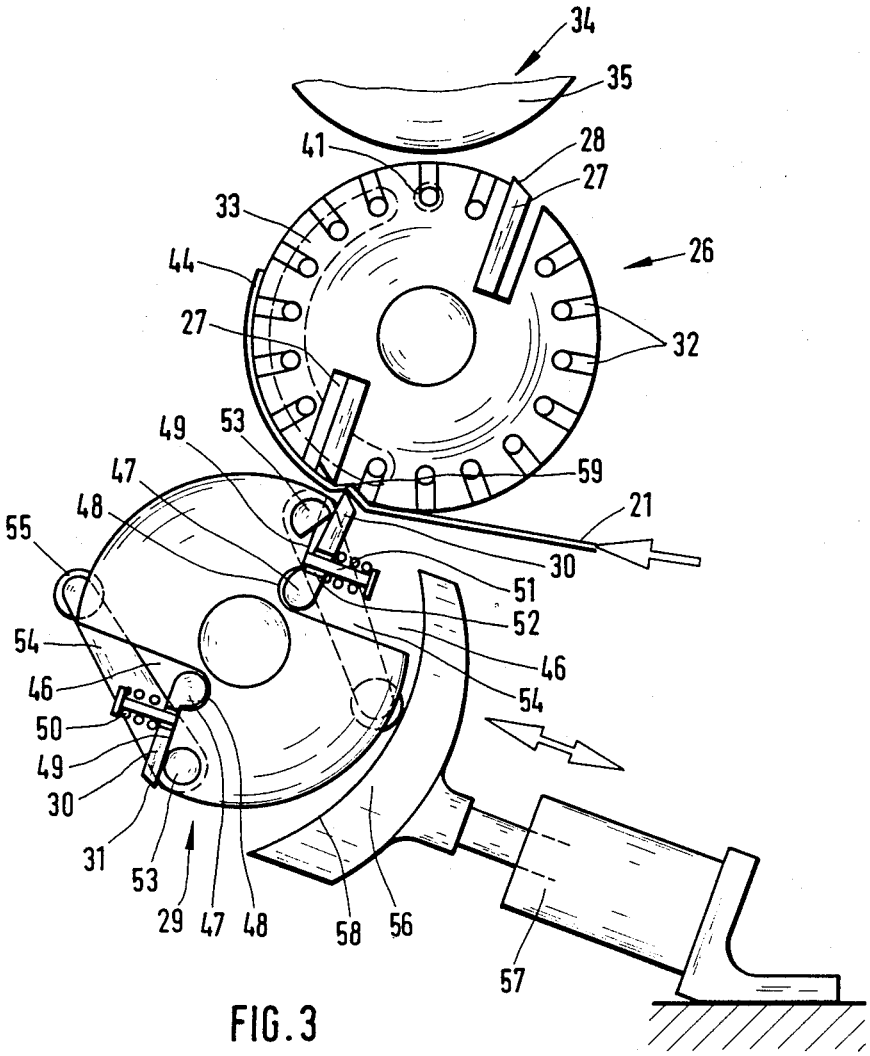

The web of material 21 is driven by means of a pair of drawing rollers 42, 43 which precede the knife rollers 26, 29 in the conveying direction. These are stopped when there is no feed of stacks 10, but in such a way that the web of material is conveyed further an amount corresponding to a portion of the web of material, specifically beyond the severing point in the region of the knife rollers 26, 29. This follow-up portion 44 amounts approximately to one quarter of the periphery of the knife roller 26 (FIG. 3). The web of material 21 comes to a stop in this position shown there. This exact stopping position is obtained because the drawing rollers 42, 43 are driven by means of a servo-motor 45 (stepping motor) which receives a stop pulse from the delivery conveyor and which then conveys the web of material 21 further an amount corresponding to the follow-up portion 44 described. The transmission of the stop signal to the servo-motor 45 is controlled in such a way that the follow-up portion 44 is always conveyed after a severing cut.

After the web of material 21 has stopped, the knife rollers 26, 29 and the transfer conveyor 34, as well as the folding turret 13, are moved further without change, in particular continuously. So that there is no severing of blanks, the knives are moved out of cutting engagement with one another. In the present exemplary embodiment, for this purpose the severing knives 30 are (temporarily) adjusted on the knife roller 29. The web of material 21, particularly its follow-up portion 44, thus rests slideably against the outer surface of the knife roller 26.

In order to adjust the severing knives 30, they are mounted moveably on the knife roller 29. In the exemplary embodiment illustrated, the knife roller 29 is equipped, on the sides located diagonally opposite one another, with recesses 46 of approximately triangular cross-section. The severing knives 30 are mounted moveably, particularly pivotably in these recesses.

A radially inner end region or edge region of the severing knives 30 is equipped with a thickened bearing portion 47 which is round, particularly cylindrical in the bearing region. This bearing portion rests rotatably (slideably) in a matching trough-shaped depression 48 in a side face 49 of the recess 46. The side face 49 directed approximately radially or parallel to an (imaginary) radial face serves at the same time as a bearing surface for the severing knife 30 in the normal or cutting position.

As a result of a slight pivoting movement about the axis of the thickened bearing portion 47, in particular as a result of the rotation of the latter in the depression 48, the severing knife 30 is moved out of the cutting position (FIG. 3, the upper severing knife 39). This pivoting movement of the severing knife 30 takes place counter to the load exerted by a spring 50. The latter is arranged on a bolt 51 which is directed transversely relative to the severing knife 30 and which passes through a bore 52 in the severing knife 30 and is fastened to the side face 49.

In order to actuate the severing knife 30 in the above-mentioned way, there is mounted in the knife roller 29 adjacent to the side face 40 an actuating member, in particular a rotatable cam piece 53 which is designed as a pivot pin which is flattened on one side and which is rotatable about an axis parallel to the axis of rotation of the knife roller 29. During rotation, an edge comes out of the plane of the side face 49 and pivots the severing knife 30. In the cutting position, the severing knife rests against the cam piece 53 in the region of the flattened portion.

Figure 2:
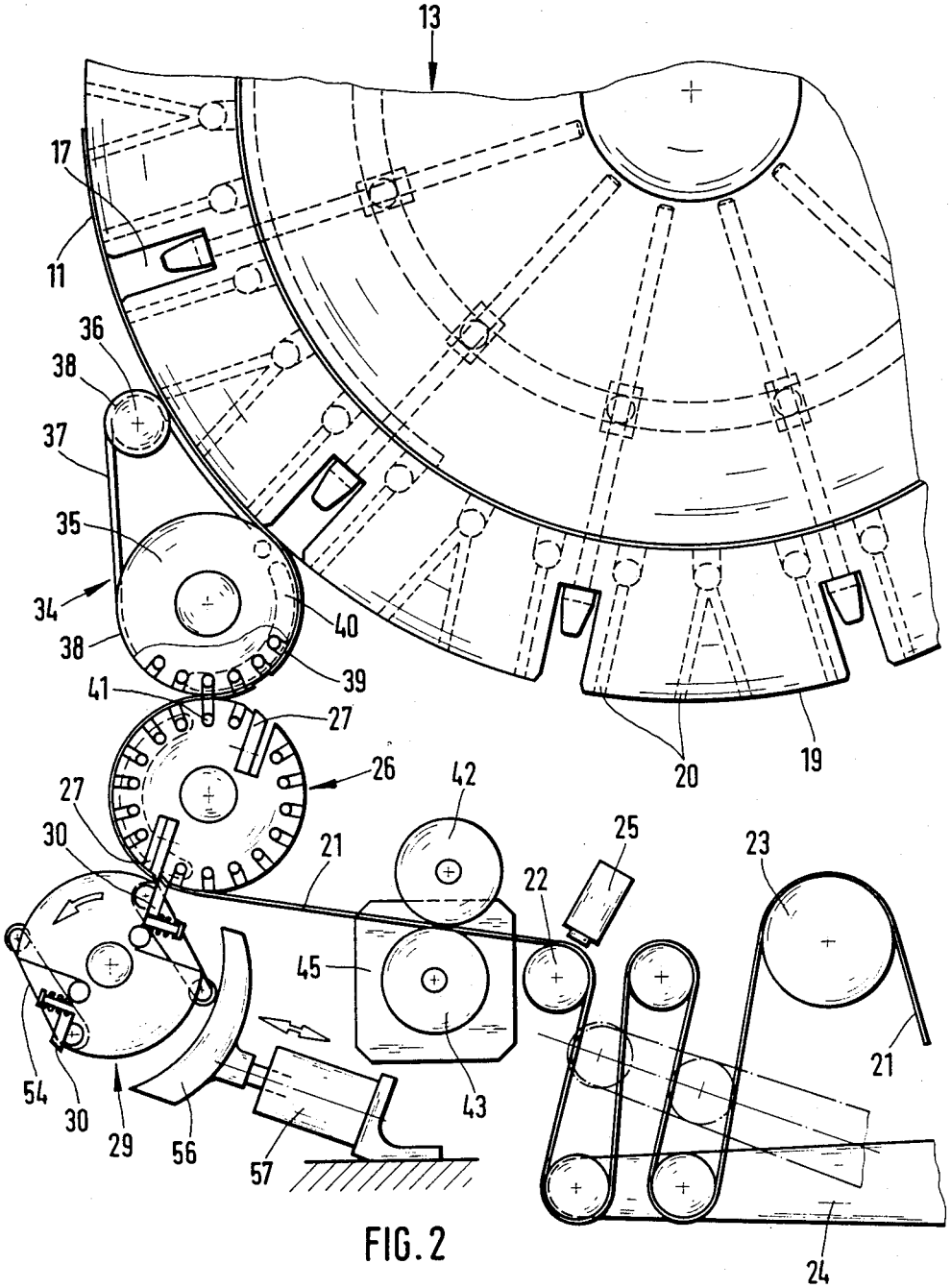

In order to execute the rotary movements of the cam piece 53, an actuating arm 54 is attached to it, in particular to a free end projecting laterally from the knife roller 29. This actuating arm 54 is provided, as its free end, with a tracer roller 55 which comes up against a moveable actuating member 54 fixed in place, in order to actuate the cam piece 53 and consequently pivot the severing knife 30. In the present case, this actuating member 54 consists of a curved segment 56 which can be moved into the working position (FIG. 3) or out of this (FIG. 2) by means of a pressure-medium cylinder 57. The curved segment 56 is designed so that, during the rotary movement of the knife roller 29, the tracer roller 55 runs freely against a supporting face 58 of the curved segment 56. During further movement, the actuating arm 54 is pivoted increasingly until the respective severing knife 30 is pivoted sufficietly far back in the region of the severing point for the web of material 21. There are therefore only very slight, short movements of the severing knives solely in the region of the severing point. Thereafter, in particular when the tracer roller 55 has left the region of the curved segment 56, the severing knife 30 returns to the normal position.

In the region of the severing point, the knife roller 26 is provided, adjacent to the counter knife 27, with a depression 59, into which the disengaged severing knife 30 penetrates briefly, thereby taking along the web of material 21, but without severing the latter.

After a phase of the interrupted feed of stacks 10 has ended, the curved segment 56 is retracted into the initial position by means of an appropriate control signal, and the drive for the drawing rollers 42, 43 is set in motion again. Blanks are now once again produced and fed exactly in the necessary relative position.

In the present case, the transfer conveyor 34 runs at a slightly higher speed than the knife roller 26. Small gaps between the successive blanks 11 are thus produced.

What is claimed is:

1. Process for the feeding blanks of packaging material to a folding turret, for the wrapping of articles or groups of articles, the blanks being severed from a continuous web of material by severing knives of rotating knife rollers and being delivered to the folding turret or to a conveyor roller preceding the latter, said process comprising controlling the feed of the blanks (11) to the folding turret (13) as a function of the feed of articles (10) to be packaged, in such a way that, when there is an interruption in the feed of articles (10), the transfer of blanks (11) to the folding turret (13) is interrupted until articles (10) are fed to the folding turret (13) once again.

2. Process according to claim 1, comprising, when the feed of blanks (11) to the folding turret (13) is interrupted: maintaining both the drive of rotating conveyor members for the blanks (11) and for the web of material (21) and also continuous rotary movement of the knife rollers (26, 29); and stopping the web of material (21) in a region in front of the knife rollers (26, 29).

3. Process according to claim 2, comprising, when there is an interruption in the feed of blanks (11) to the folding turret (13): stopping the web of material (21) in such a way that a follow-up portion (44) of the web of material (21), located at the front in the direction of transport, is conveyed beyond a severing plane formed by the severing knives (27, 30) of the knife rollers (26, 29); and moving the knife rollers (26, 29) or their knives into an ineffective position.

4. process according to claim 2 or 3, comprising: driving the web of material (21) by drawing rollers (42, 43) which precede the knife rollers (26, 29) and which are controlled as a function of the feed of articles (10) to the folding turret (13); and, upon disconnection of a drive (45) of the drawing rollers (42, 43), conveying a follow-up portion (44) of the web of material (21) until the latter stops.

5. Process according to claim 4, comprising, when there is an interruption in the feed of articles (10) to the folding turret (13), disconnecting the drive of the drawing rollers (42, 43) for the web of material (21) at the moment when a severing cut is made.

6. Apparatus for feeding blanks of packaging material to a folding turret for the packaging of articles or groups of articles, the blanks being severable from a continuous web of material by continuously rotating knife rollers with radially directed severing knives and capable of being fed to the folding turret via one of the knife rollers, and with a drive for conveying the web of material, with drawing rollers, comprising: monitoring member means for monitoring the feed of the articles (10) to the folding turret (13); means for disconnection, when there is no feed of articles (10), the conveyance of the web of material (21) or the drive for the drawing rollers (42, 43); and means for moving the severing knives (30) out of cutting engagement as a result of adjustment when the conveyance of the web of material (21) is disconnected.

7. Apparatus according to claim 6, comprising means for adjusting the severing knives (30) of a knife roller (29) in such a way that there is no cutting engagement during the further movement of the rotating knife rollers (26, 29).

8. Apparatus according to claim 7, comprising means for adjusting the severing knives (30) of the knife roller (29) in the peripheral direction counter to springloading, in such a way that at least one cutting edge (31) of the severing knives (30) is located in the region of the severing plane of the web of material (21) at a distance from the cutting edge (28) of a counter knife (27).

9. Apparatus according to claim 7 or 8, comprising means for pivotably mounting the severing knives (30) about an axis of rotation distant from the cutting edge (31) in the direction of the axis of rotation of the knife roller (29), in such a manner that the severing knives are pivotable in a direction counter to the direction of rotation of the knife roller (29) for adjustment out of cutting engagement.

10. Apparatus according to claim 9, wherein each severing knife (30) rests against an approximately radially directed knife-supporting side face (49) in a recess (46) of the knife roller (29), and is liftable from said face for movement into the position out of cutting engagement and counter to the load of a spring (50) arranged on a fixed bolt (51).

11. Apparatus according to claim 10, wherein each severing knife (30) is mounted rotatably, by means of a radially inner cylindrical thickened bearing portion (47), in a correspondingly shaped depression (48) in the side face (49).

12. Apparatus according to claim 8, comprising actuating arm means for pivotably moving each severing knife (30) and having a tracer roller (55) which rests against an adjustable member fixed in place, especially against curved segment (56).

13. Apparatus according to claim 6, comprising a transfer conveyor (34) for transferring the blank (11) to a peripheral surface (19) of the folding turret (13) and being located after the knife rollers (26, 29) in the conveying direction of the blank (11) or of the web of material (21), the transfer conveyor (34) comprising a conveyor roller (35) with suction bores (39) along the periphery.

14. Apparatus according to claim 13, wherein, connected to the conveyor roller (35) of the transfer conveyor (54), is an endless conveyor resting snugly against the peripheral surface (19) of the folding turret (13) and comprising belts (37) which are guided in peripheral grooves (38) and which run over a deflecting roller (36) located at a distance, in such a way that a conveying strand of the belts (37) rests against the peripheral surface (19).

15. Apparatus according to claim 6, comprising servo-motor means (45) for driving the drawing rollers (42, 43) to transport the web of material (21) and being activated by a monitoring member assigned to a delivery conveyor (12) for the articles (10) to be packaged.

* * * * *